US011768022B2

(12) United States Patent
Crawford et al.

(10) Patent No.: US 11,768,022 B2
(45) Date of Patent: Sep. 26, 2023

(54) LIQUID TRANSFER PUMP CYCLE

(71) Applicant: Lennox Industries Inc., Richardson, TX (US)

(72) Inventors: Carl T. Crawford, Hickory Creek, TX (US); Robert B. Uselton, Plano, TX (US)

(73) Assignee: Lennox Industries Inc., Richardson, TX (US)

( * ) Notice: Subject to any disclaimer, the term of this patent is extended or adjusted under 35 U.S.C. 154(b) by 0 days.

(21) Appl. No.: 17/851,103

(22) Filed: Jun. 28, 2022

(65) Prior Publication Data

US 2022/0325931 A1 Oct. 13, 2022

Related U.S. Application Data

(60) Division of application No. 16/899,740, filed on Jun. 12, 2020, now Pat. No. 11,402,138, which is a continuation of application No. 15/426,200, filed on Feb. 7, 2017, now Pat. No. 10,704,816.

(51) Int. Cl.
*F25B 49/02* (2006.01)

(52) U.S. Cl.
CPC ..... *F25B 49/02* (2013.01); *F25B 2400/0401* (2013.01); *F25B 2400/0411* (2013.01); *F25B 2600/2501* (2013.01); *F25B 2700/2103* (2013.01); *F25B 2700/2104* (2013.01); *F25B 2700/2106* (2013.01)

(58) Field of Classification Search
CPC ..... F25B 2400/0401; F25B 2400/0411; F25B 2600/2501; F25B 2700/2103; F25B 2700/2104; F25B 2700/2106; F25B 49/02
See application file for complete search history.

(56) References Cited

U.S. PATENT DOCUMENTS

| | | | | |
|---|---|---|---|---|
| 6,382,310 | B1 * | 5/2002 | Smith | F28B 1/06 165/146 |
| 7,581,409 | B2 * | 9/2009 | Bailey | F25B 25/00 62/181 |
| 2006/0201188 | A1 * | 9/2006 | Kopko | F25B 9/008 62/333 |
| 2011/0100041 | A1 | 5/2011 | Crawford et al. | |
| 2013/0098086 | A1 * | 4/2013 | Sillato | F25B 13/00 62/426 |
| 2014/0054013 | A1 | 2/2014 | LePoudre et al. | |
| 2022/0325931 | A1 * | 10/2022 | Crawford | F25B 49/02 |

* cited by examiner

*Primary Examiner* — Henry T Crenshaw
(74) *Attorney, Agent, or Firm* — BRADLEY ARANT BOULT CUMMINGS

(57) ABSTRACT

A method of initiating a low-energy cooling mode using a controller of an HVAC system includes measuring a temperature of ambient air proximal to a condenser coil and determining whether the temperature of the ambient air proximal the condenser coil is less than a temperature threshold. If the temperature of the ambient air is less than the temperature threshold, the HVAC system is configured to operate in a low-energy cooling mode. In the low-energy cooling mode, the controller opens a first bypass valve to allow a refrigerant to bypass a compressor and the compressor is powered off. The HVAC system is operated until a cooling demand has been met.

20 Claims, 4 Drawing Sheets

LIQUID TRANSFER PUMP CYCLE

CROSS-REFERENCE TO RELATED APPLICATION

This application is a divisional of U.S. patent application Ser. No. 16/899,740, filed on Jun. 12, 2020. U.S. patent application Ser. No. 16/899,740 is a continuation of U.S. patent application Ser. No. 15/426,200, filed on Feb. 7, 2017. U.S. patent application Ser. No. 16/899,740 and U.S. patent application Ser. No. 15/426,200 are incorporated herein by reference.

TECHNICAL FIELD

The present invention relates generally to heating, ventilating, and air conditioning (HVAC) systems and more particularly, but not by way of limitation, to an HVAC system for use in cooler ambient conditions.

BACKGROUND

HVAC systems typically include components, such as, for example, a compressor, a condenser coil, an outdoor fan, an evaporator coil, and an indoor fan. Depending upon various parameters such as, for example, set-point-temperature and humidity, the HVAC system cycles the compressor, the indoor fan, and the outdoor fan on and off to satisfy a requested cooling demand. For example, the HVAC system may be programmed to maintain a specific temperature. In order to maintain the specific temperature over a period of time, it may be necessary to cycle components such as, for example, the compressor, the indoor fan, and the outdoor fan, on and off multiple times. Compressors in particular use high amounts of electricity, which makes operating the HVAC system costly. Typically, the compressor accounts for a majority of the HVAC system's electricity usage.

When outdoor temperatures are low, a cooling demand for an interior space, such as, for example, a building or house, is typically lower than when outdoor temperatures are high. The lower cooling demand allows the compressor to operate for shorter periods of time. For variable speed compressor system, reducing the speed of the compressor does reduce the amount of electricity consumed, but even the lowest speed setting of the compressor can consume significant amounts of electricity.

SUMMARY

An HVAC system configured to provide low-energy cooling includes: an evaporator coil comprising an evaporator coil inlet and an evaporator coil outlet; a condenser coil comprising a condenser coil inlet and a condenser coil outlet, the condenser coil outlet being coupled to the evaporator coil inlet; a first bypass valve comprising a first bypass valve inlet coupled to the evaporator coil outlet and a first bypass valve outlet coupled to the condenser coil inlet; a liquid pump comprising a liquid pump inlet coupled to the condenser coil outlet and a liquid pump outlet coupled to the evaporator coil inlet; and a thermal expansion valve coupled between the liquid pump and the evaporator coil inlet. The HVAC system also includes an HVAC controller configured to: measure a temperature of ambient air proximal to the condenser coil; determine whether the temperature of the ambient air proximal to the condenser coil is less than a temperature threshold; responsive to a determination that the temperature of the ambient air is less than the temperature threshold, configure the HVAC system to operate in a low-energy cooling mode by opening the first bypass valve to allow a refrigerant to bypass a compressor and powering off the compressor; and operate the HVAC system in the low-energy cooling mode.

A method of initiating a low-energy cooling mode using a controller of an HVAC system includes measuring a temperature of ambient air proximal to a condenser coil. If the temperature of the ambient air proximal the condenser coil is less than a temperature threshold, the HVAC system is configured to operate in a low-energy cooling mode. In the low-energy cooling mode, the HVAC system is configured so that a first bypass valve is open to allow a refrigerant to bypass a compressor and the compressor is powered off. Once in the low-energy cooling mode, the HVAC system is operated until a cooling demand has been met or until operating the HVAC system is no longer desired. Once the cooling demand has been met, turning the HVAC system off. If it is determined that the cooling demand has not been met, the method returns to the measuring step to determine if the temperature of the ambient air is less than the temperature threshold.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Various embodiments of the present invention will now be described more fully with reference to the accompanying drawings. The invention may, however, be embodied in many different forms and should not be construed as limited to the embodiments set forth herein.

Figure 1:
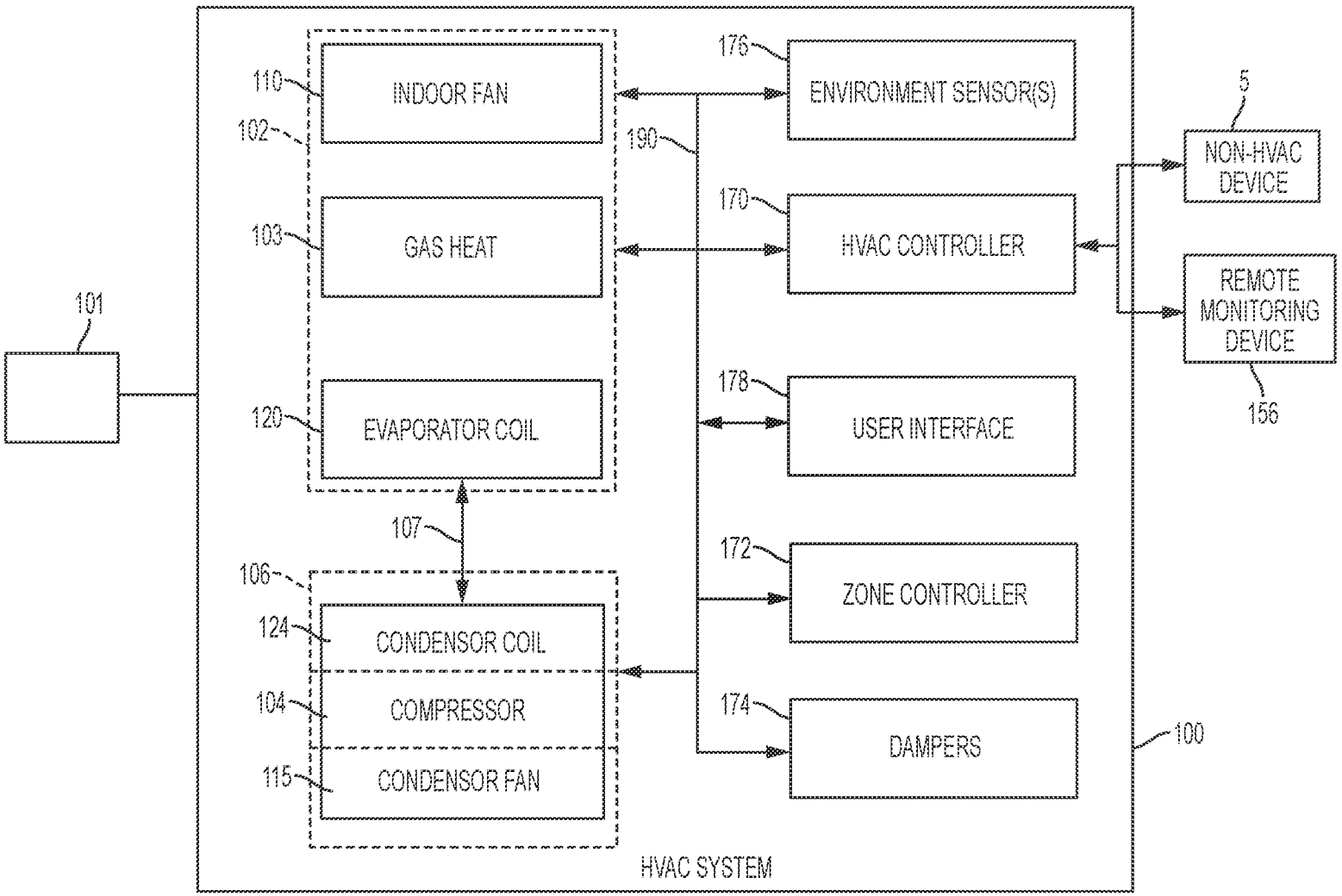
FIG. 1 is a block diagram of an illustrative HVAC system.

FIG. 1 illustrates an HVAC system 100. In a typical embodiment, the HVAC system 100 is a networked HVAC system that is configured to condition air via, for example, heating, cooling, humidifying, or dehumidifying air within an enclosed space 101. In a typical embodiment, the enclosed space 101 is, for example, a house, an office building, a warehouse, and the like. Thus, the HVAC system 100 can be a residential system or a commercial system such as, for example, a rooftop system. The HVAC system 100 includes various components; however, in other embodiments, the HVAC system 100 may include additional components that are not illustrated but typically included within HVAC systems.

The HVAC system 100 includes an indoor fan 110, a gas heat 103 typically associated with the indoor fan 110, and an evaporator coil 120, also typically associated with the indoor fan 110. The indoor fan 110, the gas heat 103, and the evaporator coil 120 are collectively referred to as an indoor unit 102. In a typical embodiment, the indoor unit 102 is located within, or in close proximity to, the enclosed space 101. The HVAC system 100 also includes a compressor 104, an associated condenser coil 124, and an associated condenser fan 115, which are collectively referred to as an outdoor unit 106. In various embodiments, the outdoor unit 106 and the indoor unit 102 are, for example, a rooftop unit or a ground-level unit. The compressor 104 and the associated condenser coil 124 are connected to the evaporator coil 120 by a refrigerant line 107. In a typical embodiment, the refrigerant line 107 includes a plurality of copper pipes that connect the associated condenser coil 124 and the compressor 104 to the evaporator coil 120. In a typical embodiment, the compressor 104 may be, for example, a single-stage compressor, a multi-stage compressor, a single-speed compressor, or a variable-speed compressor. The indoor fan 110, sometimes referred to as a blower, is configured to operate at different capacities (e.g., variable motor speeds) to circulate air through the HVAC system 100, whereby the circulated air is conditioned and supplied to the enclosed space 101.

Still referring to FIG. 1, the HVAC system 100 includes an HVAC controller 170 is configured to control operation of the various components of the HVAC system 100 such as, for example, the indoor fan 110, the gas heat 103, and the compressor 104 to regulate the environment of the enclosed space 101. In some embodiments, the HVAC system 100 can be a zoned system. The HVAC system 100 includes a zone controller 172, dampers 174, and a plurality of environment sensors 176. In a typical embodiment, the HVAC controller 170 cooperates with the zone controller 172 and the dampers 174 to regulate the environment of the enclosed space 101.

The HVAC controller 170 may be an integrated controller or a distributed controller that directs operation of the HVAC system 100. In a typical embodiment, the HVAC controller 170 includes an interface to receive, for example, thermostat calls, temperature setpoints, blower control signals, environmental conditions, and operating mode status for various zones of the HVAC system 100. The environmental conditions may include indoor temperature and relative humidity of the enclosed space 101. In a typical embodiment, the HVAC controller 170 also includes a processor and a memory to direct operation of the HVAC system 100 including, for example, a speed of the indoor fan 110.

Still referring to FIG. 1, in some embodiments, the plurality of environment sensors 176 are associated with the HVAC controller 170 and also optionally associated with a user interface 178. The plurality of environment sensors 176 provides environmental information within a zone or zones of the enclosed space 101 such as, for example, temperature and humidity of the enclosed space 101 to the HVAC controller 170. The plurality of environment sensors 176 may also send the environmental information to a display of the user interface 178. In some embodiments, the user interface 178 provides additional functions such as, for example, operational, diagnostic, status message display, and a visual interface that allows at least one of an installer, a user, a support entity, and a service provider to perform actions with respect to the HVAC system 100. In some embodiments, the user interface 178 is, for example, a thermostat. In other embodiments, the user interface 178 is associated with at least one sensor of the plurality of environment sensors 176 to determine the environmental condition information and communicate that information to the user. The user interface 178 may also include a display, buttons, a microphone, a speaker, or other components to communicate with the user. Additionally, the user interface 178 may include a processor and memory configured to receive user-determined parameters such as, for example, a relative humidity of the enclosed space 101 and to calculate operational parameters of the HVAC system 100 as disclosed herein.

The HVAC system 100 is configured to communicate with a plurality of devices such as, for example, a monitoring device 156, a communication device 155, and the like. In a typical embodiment, and as shown in FIG. 1, the monitoring device 156 is not part of the HVAC system 100. For example, the monitoring device 156 is a server or computer of a third party such as, for example, a manufacturer, a support entity, a service provider, and the like. In some embodiments, the monitoring device 156 is located at an office of, for example, the manufacturer, the support entity, the service provider, and the like.

In a typical embodiment, the communication device 155 is a non-HVAC device having a primary function that is not associated with HVAC systems. For example, non-HVAC devices include mobile-computing devices configured to interact with the HVAC system 100 to monitor and modify at least some of the operating parameters of the HVAC system 100. Mobile computing devices may be, for example, a personal computer (e.g., desktop or laptop), a tablet computer, a mobile device (e.g., smart phone), and the like. In a typical embodiment, the communication device 155 includes at least one processor, memory, and a user interface such as a display. One skilled in the art will also understand that the communication device 155 disclosed herein includes other components that are typically included in such devices including, for example, a power supply, a communications interface, and the like.

The zone controller 172 is configured to manage movement of conditioned air to designated zones of the enclosed space 101. Each of the designated zones includes at least one conditioning or demand unit such as, for example, the gas heat 103 and the user interface 178, only one instance of the user interface 178 being expressly shown in FIG. 1. such as, for example, the thermostat. The HVAC system 100 allows the user to independently control the temperature in the designated zones. In a typical embodiment, the zone controller 172 operates dampers 174 to control air flow to the zones of the enclosed space 101.

A data bus 190, which in the illustrated embodiment is a serial bus, couples various components of the HVAC system 100 together such that data is communicated therebetween. The data bus 190 may include, for example, any combination of hardware, software embedded in a computer readable medium, or encoded logic incorporated in hardware or otherwise stored (e.g., firmware) to couple components of the HVAC system 100 to each other. As an example and not by way of limitation, the data bus 190 may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus 190 may include any number, type, or configuration of data buses 190, where appropriate. In particular embodiments, one or more data buses 190 (which may each include an address bus and a data bus) may couple the HVAC controller 170 to other components of the HVAC system 100. In other embodiments, connections between various components of the HVAC system 100 are wired. For example, conventional cable and contacts may be used to couple the HVAC controller 170 to the various components. In some embodiments, a wireless connection is employed to provide at least some of the connections between components of the HVAC system 100 such as, for example, a connection between the HVAC controller 170 and the indoor fan 110 or the plurality of environment sensors 176.

Figure 2:
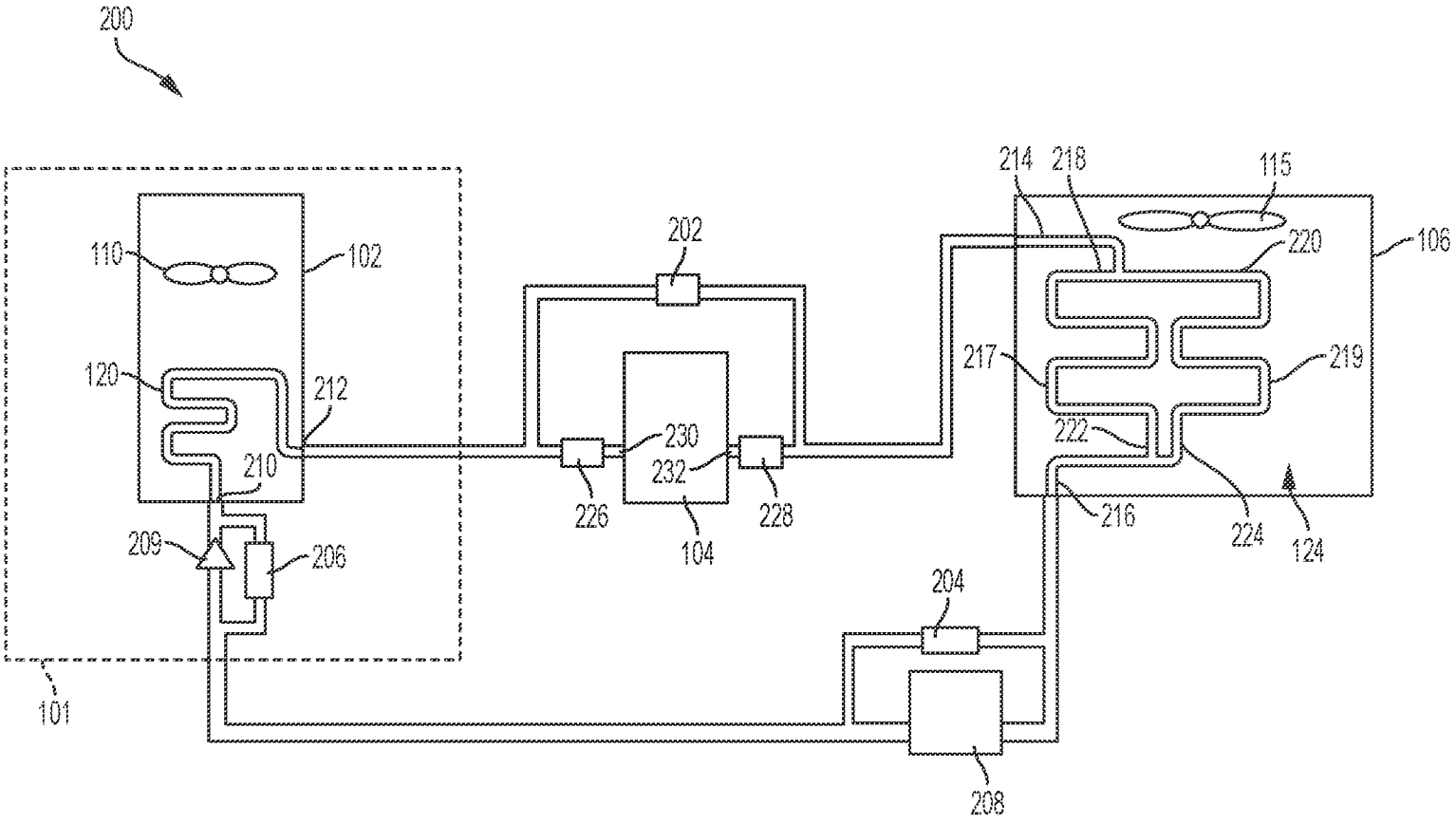
FIG. 2 is a schematic diagram illustrating a configuration of an HVAC system 200 configured for low-energy cooling.

FIG. 2 is a schematic diagram illustrating a configuration of an HVAC system 200 configured for low-energy cooling. The HVAC system 200 includes some of the same components as the HVAC system 100, such as, for example, the indoor unit 102, the compressor 104, and the outdoor unit 106. The indoor unit 102 includes the evaporator coil 120 and the indoor fan 110. The outdoor unit 106 includes the condenser coil 124 and an outdoor fan 115. The HVAC system 200 also includes the following components: a first bypass valve 202, a check valve 204, a second bypass valve 206, and a liquid pump 208, and a thermal expansion valve 209.

The HVAC system 200 may be operated in various modes. For example, the HVAC system 200 may be operated in a conventional operating mode or in a low-energy cooling mode. In the conventional operating mode, the compressor 104 is used to compress a refrigerant to provide cooling capacity for the HVAC system 200. The conventional operating mode is typically used when cooling demand is high. For example, the conventional operating mode is typically used when ambient temperatures are above 70° F.

In the low-energy cooling mode, the compressor 104 is powered off and the refrigerant bypasses the compressor 104. Because the compressor 104 is powered off, an amount of power consumed by the HVAC system 200 is significantly reduced relative to the conventional operating mode. Compared to the conventional operating mode, the low-energy cooling mode is typically used when the cooling demand is lower. For example, the low-energy cooling mode is typically used when ambient temperatures are below 70° F. The conventional operating mode and the low-energy cooling mode of the HVAC system 200 are discussed in more detail below.

When operating in the conventional operating mode, the second bypass valve 206 is closed and a high-pressure liquid refrigerant flows through the thermal expansion valve 209 and into the evaporator coil 120 via an evaporator coil inlet 210. The thermal expansion valve 209 reduces the high-pressure liquid refrigerant's pressure, which allows the high-pressure liquid refrigerant to change phases from liquid to vapor, forming a vaporized refrigerant. The phase change from liquid to vapor is an endothermic process that absorbs heat. As the vaporized refrigerant flows through the evaporator coil 120, heat is absorbed into the vaporized refrigerant from air surrounding the evaporator coil 120. In a typical embodiment, the air surrounding the evaporator coil 120 is air from the enclosed space 101 that is blown over the evaporator coil 120 by the indoor fan 110. The air from the enclosed space 101 that is blown over the evaporator coil 120 is cooled by the evaporator coil 120 and fed back to the enclosed space 101 to cool the enclosed space 101. In a typical embodiment, the indoor fan 110 is a variable-speed fan. Altering the speed of the indoor fan 110 allows for optimization of heat transfer between the air from the enclosed space 101 and the vaporized refrigerant.

The vaporized refrigerant exits the evaporator coil 120 via an evaporator coil outlet 212 and is fed into the compressor 104. When the HVAC system 200 is operated in the conventional operating mode, the first bypass valve 202 is closed to direct the vaporized refrigerant into the compressor 104. As shown in FIG. 2, a compressor inlet valve 226 is coupled to a compressor inlet 230 of the compressor 104 and a compressor outlet valve 228 is coupled to a compressor outlet 232 of the compressor 104. In the conventional operating mode, the compressor inlet valve 226 and the compressor outlet valve 228 are in the open position to permit the vaporized refrigerant to enter and exit the compressor 104. The compressor 104 compresses the vaporized refrigerant into a high-pressure vaporized refrigerant.

The high-pressure vaporized refrigerant is fed from the compressor 104 to the condenser coil 124 via a condenser coil inlet 214. As the high-pressure vaporized refrigerant flows through the condenser coil 124, ambient air is blown around the condenser coil 124 by the outdoor fan 115 to remove heat from the high-pressure vaporized refrigerant. In a typical embodiment, the outdoor fan 115 is a variable-speed fan. Altering the speed of the outdoor fan 115 allows for optimization of heat transfer between the ambient air and the high-pressure vaporized refrigerant. Removing heat from the high-pressure vaporized refrigerant condenses the high-pressure vaporized refrigerant into a high-pressure liquid refrigerant.

Figure 3:
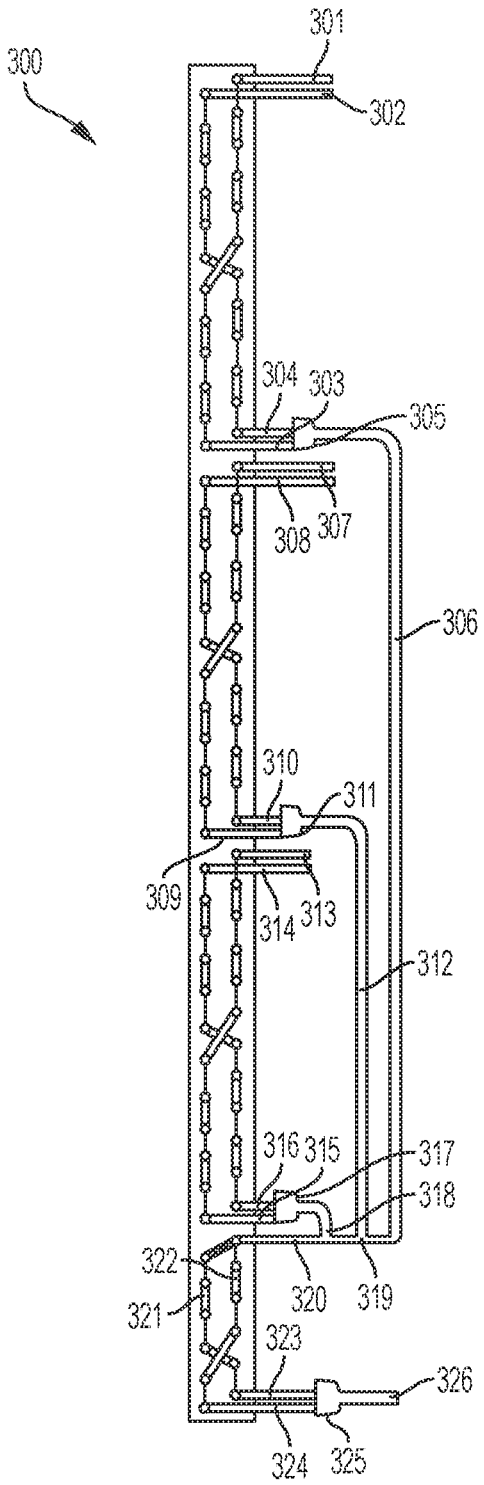
FIG. 3 is a schematic diagram of an illustrative condenser coil for use with an HVAC system.

As shown in FIG. 2, the condenser coil 124 includes a first cooling path 217 and a second cooling path 219. In other embodiments, the condenser coil 124 may include one cooling path or three or more cooling paths as desired. FIG. 3, discussed in more detail below, is a schematic of an illustrative condenser coil 300 that may be used in place of the condenser coil 124. The first cooling path 217 includes a first cooling-path inlet 218 and a first cooling-path outlet 222. The second cooling path 219 includes a second cooling-path inlet 220 and a second cooling-path outlet 224. The first cooling-path inlet 218 and the second cooling-path inlet 220 are positioned at a height that is greater than a height of the first cooling-path outlet 222 and the second cooling-path outlet 224. Positioning the first cooling-path inlet 218 and the second cooling-path inlet 220 above the first cooling-path outlet 222 and the second cooling-path outlet 224 is beneficial when the HVAC system 200 operates in the low-energy cooling mode.

The high-pressure liquid refrigerant is fed from the condenser coil 124 via a condenser coil outlet 216 to the thermal expansion valve 209. When the HVAC system 200 operates in the conventional operating mode, the high-pressure liquid refrigerant passes through the check valve 204 and bypasses the liquid pump 208. The high-pressure liquid refrigerant then passes through the thermal expansion valve 209, and the cycle repeats to provide additional cooling capacity to the enclosed space 101.

When the ambient air is at a temperature below a temperature threshold specified by the system, such as, for example, about 70° F., the HVAC system 200 is operated in the low-energy cooling mode. The general operation of the HVAC system 200 in the low-energy cooling mode is similar to the operation described above relative to the conventional operating mode, but a few key differences exist. When the HVAC system 200 operates in the low-energy cooling mode, the compressor 104 is powered off, the compressor inlet valve 226 and the compressor outlet valve 228 are closed and the first bypass valve 202 is opened. The compressor inlet valve 226 and the compressor outlet valve 228 are closed to prevent refrigerant from pooling in the compressor 104. In some embodiments, the compressor 104 includes a check valve at the compressor outlet 232. When the compressor 104 includes a check valve at the compressor outlet 232, it may be possible to eliminate one or both of the compressor inlet valve 226 and the compressor outlet valve 228 as the check valve at the compressor outlet 232 may be sufficient to prevent vaporized refrigerant from flowing back into the compressor outlet 232 and pooling in the compressor 104.

When the HVAC system 200 operates in the low-energy cooling mode, the vaporized refrigerant that leaves the evaporator coil 120 bypasses the compressor 104 and flows through the first bypass valve 202 to the condenser coil 124. As the vaporized refrigerant flows through the condenser coil 124, heat is absorbed from the vaporized refrigerant and into the ambient air that is blown over the condenser coil 124 by the outdoor fan 115, which condenses the vaporized refrigerant into a liquid refrigerant. Compared to the conventional operating mode, the pressure within the condenser coil 124 when the HVAC system 200 operates in the low-energy cooling mode is reduced because the compressor 104 does not pressurize the vaporized refrigerant. At lower pressures, the vaporized refrigerant flowing through the condenser coil 124 may not condense properly if the refrigerant is forced to flow to higher elevations relative to an inlet height. Improper condensing can result in a mixture of vapor and liquid refrigerant exiting the condenser coil 124. Preventing vaporized refrigerant from coming out of the condenser coil 124 is preferable because performance of the liquid pump 208 suffers when too much vaporized refrigerant is present. Positioning the first cooling-path inlet 218 and the second cooling-path inlet 220 at a height above the first cooling-path outlet 222 and the second cooling-path outlet 224, respectively, reduces the possibility of vaporized refrigerant exiting the condenser coil 124 and entering the liquid pump 208.

The liquid pump 208 pumps the liquid refrigerant from the condenser coil 124 to the indoor unit 102. Check valve 204 prevents liquid refrigerant from returning directly to the inlet of the liquid refrigerant pump. In a typical embodiment, the liquid pump 208 is a gear pump. In other embodiments, the liquid pump 208 may be any of a variety of pumps adapted to pump liquids, such as, for example, a diaphragm pump. In a typical embodiment, the liquid pump 208 provides a relatively small amount of energy to the liquid refrigerant. The liquid pump 208 provides enough energy to the liquid refrigerant to cause the liquid refrigerant to be fed to the evaporator coil 120.

Prior to entering the evaporator coil 120, the liquid refrigerant must pass through either the thermal expansion valve 209 or the second bypass valve 206. During the conventional operating mode, the high-pressure liquid refrigerant is typically at a pressure of between 200 and 500 psi. During the low-energy cooling mode, the liquid refrigerant is typically at a pressure of between 160 and 200 psi. Because of the lower incoming pressure of the liquid refrigerant when operating in the low-energy cooling mode, the thermal expansion valve 209 may not open enough between 160 and 200 psi. For example, the pressure of the liquid refrigerant may be too low for the liquid refrigerant to pass through the thermal expansion valve 209 and into the evaporator coil 120. In order for the liquid refrigerant to reach the evaporator coil 120, the second bypass valve 206 is opened to allow the liquid refrigerant to bypass the thermal expansion valve 209. In some embodiments, the thermal expansion valve 209 may have a wider range of openings. For example, the thermal expansion valve may have the capability to open fully and offer no restrictions at pressures between 160 and 200 psi. In such embodiments, the second bypass valve 206 is unnecessary and may be removed from the HVAC system 200.

After passing through the second bypass valve 206 or the thermal expansion valve 209, the liquid refrigerant is fed into the evaporator coil 120. The liquid refrigerant evaporates into a vaporized refrigerant within the evaporator coil 120 and absorbs heat from air from the enclosed space 101 that is blown over the evaporator coil 120 by the indoor fan 110. The vaporized refrigerant exits the evaporator coil 120 and is fed back to the first bypass valve 202, and the cycle is repeated to continue to provide additional cooling capacity to the enclosed space 101 as needed.

In some embodiments, the HVAC system 200 may be used with an economizer. An economizer allows ambient air from outside the enclosed space 101 to be blown into the enclosed space 101. Blowing ambient air into the enclosed space 101 is desirable when the ambient air is near or below a temperature desired for the enclosed space 101.

Compared to running the HVAC system 200 in the conventional operating mode, the low-energy cooling mode greatly reduces an amount of power consumed by the HVAC system 200. Table 1 below shows illustrative performance data comparing an HVAC system, such as the HVAC system 200, operating in the conventional mode and in the low-energy cooling mode:

TABLE 1

HVAC System Performance Data

| | Air Side Capacity (BTUH) | Efficiency (EER) | Indoor Airflow (CFM) | Total Power (Watts) | Compressor Power (W) | ID Fan Power (W) | OD Fan Power (W) | Liquid Pump Power (W) |
|---|---|---|---|---|---|---|---|---|
| Conventional Mode | 10,675 | 49 | 574 | 219.2 | 143.4 | 44.4 | 31.6 | 0 |
| Low-Energy Cooling Mode | 7,241 | 59 | 793 | 133 | 4 | 71 | 39 | 19 |

The data shown in Table 1 was acquired for an HVAC system 200 running at an indoor temperature of 80° F. and an ambient temperature of 67° F. As shown in Table 1, running the HVAC system 200 in the low-energy cooling mode increased the energy efficiency ratio (EER) from 49 to 59 and also maintained the air side and refrigerant side capacities at levels high enough meet a cooling demand for a building.

Table 1 also shows that operating the HVAC system 200 in the low-energy cooling mode reduced the total power consumption of the system from 219.2 watts to 133 watts. The power savings comes from eliminating almost all of the power consumed by the compressor 104. While some of the power savings from turning off the compressor 104 is negated by the power consumed by the liquid pump 208 and an increase in the power consumed by the indoor fan 110, the net power savings was still greater than 86 watts.

FIG. 3 is a schematic diagram of an illustrative condenser coil 300 for use with an HVAC system, such as, for example, the HVAC system 200. The condenser coil 300 may be swapped with the condenser coil 124 of FIGS. 1 and 2. The condenser coil 300 includes six primary cooling paths and two secondary cooling paths through which a refrigerant can flow to reject heat from the refrigerant into the ambient air that surrounds the condenser coil 300. For example, the refrigerant may be: 1) the high-pressure vaporized refrigerant from the compressor 104 when the HVAC system 200 operates in the conventional operating mode, or 2) the vaporized refrigerant from the first bypass valve 202 when the HVAC system 200 operates in the low-energy cooling mode. In other embodiments, more or fewer primary and secondary cooling paths may be included based on various design parameters.

The first primary cooling path includes a first cooling-path inlet 301 and a first cooling-path outlet 303. The second primary cooling path includes a second cooling-path inlet 302 and a second cooling-path outlet 304. The first cooling-path outlet 303 and the second cooling-path outlet 304 are coupled to a first collector 305 to direct refrigerant through a first collection tube 306. The first collection tube 306 directs refrigerant to a secondary collector 319 that collects refrigerant to be directed into the secondary cooling paths.

The third primary cooling path includes a third cooling-path inlet 307 and a third cooling-path outlet 309. The fourth primary cooling path includes a fourth cooling-path inlet 308 and a fourth cooling-path outlet 310. The third cooling-path outlet 309 and the fourth cooling-path outlet 310 are coupled to a second collector 311 to direct refrigerant through a second collection tube 312. The second collection tube 312 directs refrigerant to the secondary collector 319 so that the refrigerant is directed into the secondary cooling paths.

The fifth primary cooling path includes a fifth cooling-path inlet 313 and a fifth cooling-path outlet 315. The sixth primary cooling path includes a sixth cooling-path inlet 314 and a sixth cooling-path outlet 316. The fifth cooling-path outlet 315 and the sixth cooling-path outlet 316 are coupled to a third collector 317 to direct refrigerant through a third collection tube 318. The third collection tube 318 directs refrigerant to the secondary collector 319 so that the refrigerant is directed into the secondary cooling paths.

The secondary cooling paths include an inlet 320 that collects refrigerant from the secondary collector 319 and feeds the refrigerant into a first secondary cooling path 321 and a second secondary cooling path 322. The first secondary cooling path 321 includes a cooling-path outlet 323 that is coupled to a fourth collector 325 and the second secondary cooling path includes a cooling-path outlet 324 that is also coupled to the fourth collector 325. The fourth collector 325 is coupled to an outlet 326 that permits the refrigerant to exit the condenser coil 300.

Though not shown, each of the first cooling-path inlet 301, the second cooling-path inlet 302, the third cooling-path inlet 307, the fourth cooling-path inlet 308, the fifth cooling-path inlet 313, and the sixth cooling-path inlet 314 may be coupled to an inlet collector that collects refrigerant from the compressor 104 when the HVAC system 200 operates in the conventional operating mode or the first bypass valve 202 when the HVAC system 200 operates in the low-energy cooling mode. The inlet collector distributes the refrigerant to each of the first cooling-path inlet 301, the second cooling-path inlet 302, the third cooling-path inlet 307, the fourth cooling-path inlet 308, the fifth cooling-path inlet 313, and the sixth cooling-path inlet 314.

Figure 4:
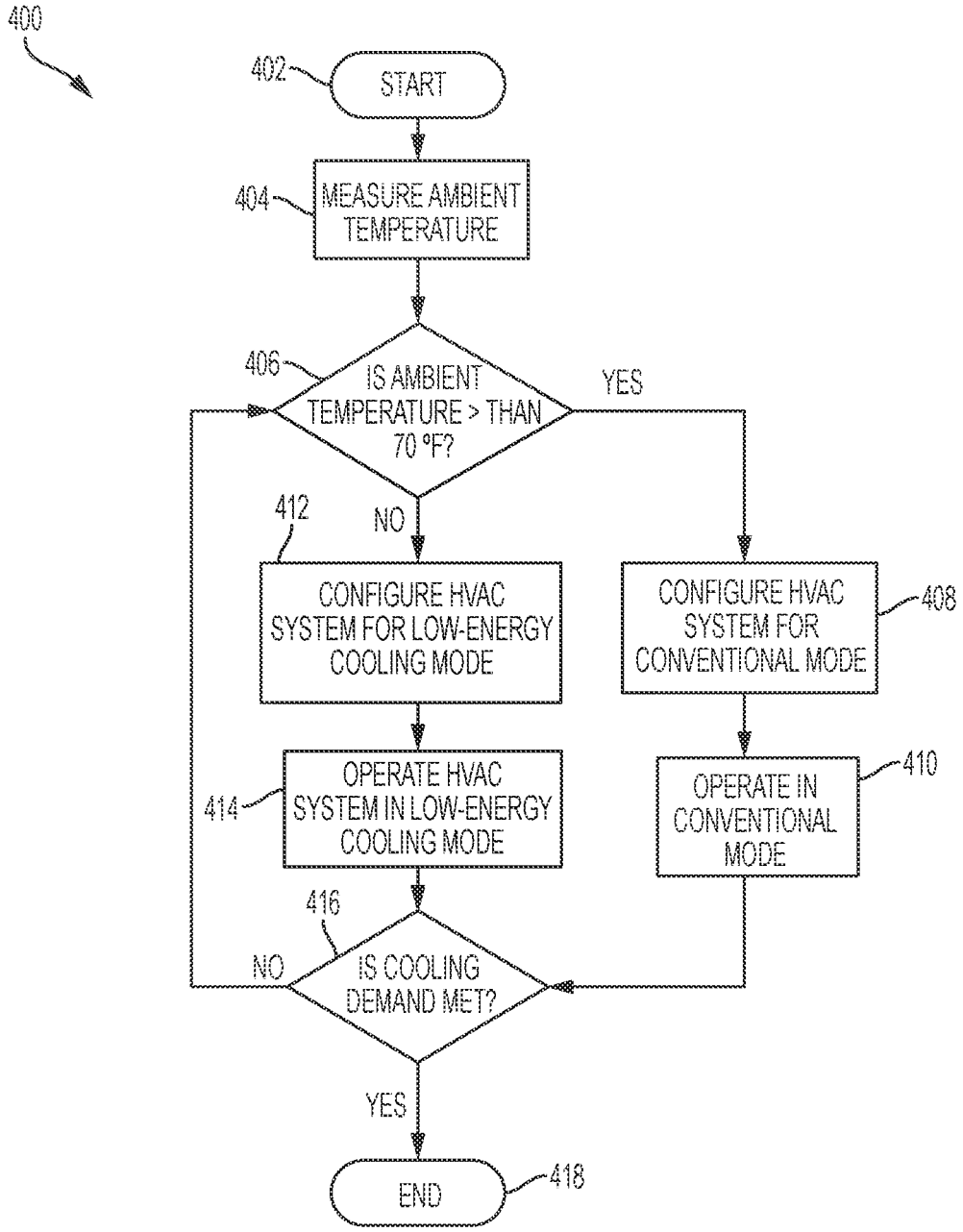
FIG. 4 is a flow diagram illustrating a method of providing low-energy cooling with an HVAC system.

FIG. 4 is a flow diagram illustrating a process 400 for providing low-energy cooling with an HVAC system. For illustrative purposes, the process 400 will be described herein relative to the HVAC system 200 of FIG. 2. In a typical embodiment, steps of the process 400 are executed by the HVAC controller 170. The process 400 begins at step 402. At step 404, the HVAC controller 170 measures a temperature of ambient air proximal to the condenser coil 124. In a typical embodiment, the temperature of the ambient air is measured with a temperature sensor located near the condenser coil 124 or may be provided by either of the communication device 155 or the monitoring device 156. After the temperature of the ambient air has been measured, the process 400 proceeds to step 406.

At step 406, the HVAC controller 170 determines whether the temperature of the ambient air is greater than 70° F. If it is determined at step 406 that the temperature of the ambient air is greater than 70° F., the process 400 proceeds to step 408. However, if it is determined at step 406 that the temperature of the ambient air is less than or equal to 70° F., the process 400 proceeds to step 412.

At step 408, the HVAC controller 170 configures the HVAC system 200 to operate in the conventional operating mode. In the conventional operating mode, the first bypass valve 202 is closed, the compressor 104 is powered on, and the liquid pump 208 is powered off. The first bypass valve 202 is closed so that vaporized refrigerant from the evaporator coil 120 is fed into the compressor 104 for compressing. The check valve 204 is open so high-pressure liquid refrigerant from the condenser coil 124 bypasses the liquid pump 208 and is fed to the thermal expansion valve 209. In embodiments of the HVAC system 200 that include the second bypass valve 206, the second bypass valve 206 is closed to force the high-pressure liquid refrigerant from the condenser coil 124 through the thermal expansion valve 209. After the HVAC system 200 is configured to operate in the conventional operating mode, the process 400 then proceeds to step 410. At step 410, the HVAC system 200 operates in the conventional operating mode to provide cool air to the enclosed space 101. After step 410, the process 400 proceeds to step 416.

At step 412, the HVAC controller 170 configures the HVAC system 200 to operate in the in low-energy cooling mode. In the low-energy cooling mode, the first bypass valve 202 is opened, the compressor 104 is powered off, and the liquid pump 208 is powered on. The first bypass valve 202 is opened to allow vaporized refrigerant from the evaporator coil 120 to bypass the compressor 104. The check valve 204 prevents the liquid refrigerant from recirculating directly back to the liquid pump 208 inlet. In embodiments of the HVAC system 200 that include the second bypass valve 206, the second bypass valve 206 is opened to allow the liquid refrigerant from the liquid pump 208 to bypass the thermal expansion valve 209 and enter the evaporator coil 120. The process 400 then proceeds to step 414. At step 414, the HVAC system 200 operates in the low-energy cooling mode to provide cool air to the enclosed space 101. After step 414, the process 400 proceeds to step 416

At step 416, the HVAC controller 170 determines if a cooling demand for the enclosed space 101 has been met. If it is determined at step 416 that the cooling demand for the enclosed space 101 has been met, the process 400 proceeds to step 418. However, if it is determined at step 416 that the cooling demand has not been met, the process 400 returns to step 404. At step 418, the HVAC controller 170 shuts down the HVAC system 200 and the process 400 ends.

The process 400 described above may be modified to satisfy various design parameters. For example, steps may be removed, added, or changed. For example, in some embodiments the HVAC controller 170 can adjust a speed of the indoor fan 110 to optimize heat transfer between the air from the enclosed space that surrounds the evaporator coil 120 and the evaporator coil 120. The HVAC controller 170 can also adjust a speed of the outdoor fan 115 to optimize heat transfer between the ambient air that surrounds the condenser coil 124 and the condenser coil 124.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

What is claimed is:

1. An HVAC system configured to provide low-energy cooling, the HVAC system comprising:

an evaporator coil comprising an evaporator coil inlet and an evaporator coil outlet;

a condenser coil comprising a condenser coil inlet and a condenser coil outlet, the condenser coil outlet being coupled to the evaporator coil inlet, the condenser coil comprising:

a primary cooling path coupled to a first collector, wherein the primary cooling path comprises a first cooling path having a first cooling-path inlet and a first cooling-path outlet;

a secondary cooling path coupled to a secondary cooling path inlet; and the first cooling-path outlet is coupled to the secondary cooling path inlet via a first collection tube to direct a refrigerant to the secondary cooling path from the first collector of the primary cooling path, wherein the first collection tube bypasses a second primary cooling path inlet and a second primary cooling path outlet;

a first bypass valve comprising a first bypass valve inlet coupled to the evaporator coil outlet and a first bypass valve outlet coupled to the condenser coil inlet;

a second bypass valve disposed in parallel with a thermal expansion valve between a liquid pump and the evaporator coil inlet; and an HVAC controller configured to:

measure, using a temperature sensor, a temperature of ambient air proximal to the condenser coil;

determine whether the temperature of the ambient air proximal to the condenser coil is less than a temperature threshold specified by the HVAC system; and responsive to a determination that the temperature of the ambient air is not less than the temperature threshold specified by the HVAC system, configure the HVAC system to operate by closing the first bypass valve, powering on a compressor, and powering off the liquid pump.

2. The HVAC system of claim 1, comprising:

responsive to a determination that the temperature of the ambient air is less than the temperature threshold specified by the HVAC system, configure the HVAC system to operate in a first cooling mode by opening the first bypass valve to allow the refrigerant to bypass the compressor and powering off the compressor; and operate the HVAC system in the first cooling mode.

3. The HVAC system of claim 2, wherein the HVAC controller is configured to:

responsive to the operating, determine if a cooling demand has been met;

responsive to a determination that the cooling demand has been met, turn off the HVAC system; and responsive to a determination that the cooling demand has not been met, measure the temperature of the ambient air.

4. The HVAC system of claim 1, wherein:

the liquid pump comprising a liquid pump inlet coupled to the condenser coil outlet and a liquid pump outlet coupled to the evaporator coil inlet;

the thermal expansion valve is coupled between the liquid pump and the evaporator coil inlet;

the compressor comprises a compressor inlet and a compressor outlet; and the compressor inlet is coupled to the evaporator coil outlet and the compressor outlet is coupled to the condenser coil inlet.

5. The HVAC system of claim 4, comprising a compressor outlet valve coupled to the compressor outlet and configured to prevent the refrigerant from flowing into the compressor via the compressor outlet.

6. The HVAC system of claim 2, wherein the first cooling-path inlet is positioned at a height that is greater than the first cooling-path outlet.

7. The HVAC system of claim 6, wherein the primary cooling path comprises:

a second cooling path comprising a second cooling-path inlet and a second cooling-path outlet; and wherein the second cooling-path inlet is positioned at a height that is greater than the second cooling-path outlet.

8. The HVAC system of claim 7, wherein the secondary cooling path comprises a third cooling path and a fourth cooling path.

9. The HVAC system of claim 2, comprising a check valve, the check valve comprising a check valve inlet coupled to the condenser coil outlet and a check valve outlet coupled to the thermal expansion valve.

10. The HVAC system of claim 1, wherein the thermal expansion valve is configured to operate at pressures between 160 and 200 psi.

11. The HVAC system of claim 1, comprising:

an indoor fan positioned proximal to the evaporator coil to blow air from an enclosed space around the evaporator coil; and an outdoor fan positioned proximal to the condenser coil to blow ambient air around the condenser coil.

12. An HVAC system configured to provide low-energy cooling, the HVAC system comprising:

an evaporator coil comprising an evaporator coil inlet and an evaporator coil outlet;

a condenser coil comprising a condenser coil inlet and a condenser coil outlet, the condenser coil outlet being coupled to the evaporator coil inlet, the condenser coil comprising:

a primary cooling path coupled to a first collector, wherein the primary cooling path comprises a first cooling path having a first cooling-path inlet and a first cooling-path outlet;

a secondary cooling path coupled to a secondary cooling path inlet; and the first cooling-path outlet is coupled to the secondary cooling path inlet via a first collection tube to direct a refrigerant to the secondary cooling path from the first collector of the primary cooling path, wherein the first collection tube bypasses a second primary cooling path inlet and a second primary cooling path outlet;

a first bypass valve comprising a first bypass valve inlet coupled to the evaporator coil outlet and a first bypass valve outlet coupled to the condenser coil inlet; and an HVAC controller configured to:

measure, using a temperature sensor, a temperature of ambient air proximal to the condenser coil;

determine whether the temperature of the ambient air proximal the condenser coil is less than a temperature threshold specified by the HVAC system;

responsive to a determination that the temperature of the ambient air is less than the temperature threshold specified by the HVAC system, configure the HVAC system to operate in a low-energy cooling mode.

13. The HVAC system of claim 12, wherein operating the HVAC system in the low-energy cooling mode comprises opening the first bypass valve, powering off a compressor, and powering on a liquid pump.

14. The HVAC system of claim 13, comprising a second bypass valve disposed in parallel with a thermal expansion valve between the liquid pump and the evaporator coil inlet.

15. The HVAC system of claim 14, wherein the HVAC controller is configured to:

responsive to the operating, determine if a cooling demand has been met;

responsive to a determination that the cooling demand has been met, turn the HVAC system off; and responsive to a determination that the cooling demand has not been met, measure the temperature of the ambient air.

16. The HVAC system of claim 12, wherein the first cooling-path inlet is positioned at a height that is greater than the first cooling-path outlet.

17. The HVAC system of claim 16, wherein the primary cooling path comprises:

a second cooling path comprising a second cooling-path inlet and a second cooling-path outlet; and wherein the second cooling-path inlet is positioned at a height that is greater than the second cooling-path outlet.

18. The HVAC system of claim 17, wherein the secondary cooling path comprises a third cooling path and a fourth cooling path.

19. The HVAC system of claim 15, comprising a check valve, the check valve comprising a check valve inlet coupled to the condenser coil outlet and a check valve outlet coupled to the thermal expansion valve.

20. An HVAC system configured to provide low-energy cooling, the HVAC system comprising:

an evaporator coil comprising an evaporator coil inlet and an evaporator coil outlet;

a condenser coil comprising a condenser coil inlet and a condenser coil outlet, the condenser coil outlet being coupled to the evaporator coil inlet, the condenser coil comprising:

a primary cooling path coupled to a first collector;

a secondary cooling path coupled to a secondary cooling path inlet; and a first cooling-path outlet coupled to the secondary cooling path inlet via a first collection tube to direct a refrigerant to the secondary cooling path from the first collector of the primary cooling path, wherein the first collection tube bypasses a second primary cooling path inlet and a second primary cooling path outlet;

a first bypass valve comprising a first bypass valve inlet coupled to the evaporator coil outlet and a first bypass valve outlet coupled to the condenser coil inlet; and an HVAC controller configured to:

measure, using a temperature sensor, a temperature of ambient air proximal to the condenser coil;

determine whether the temperature of the ambient air proximal the condenser coil is less than a temperature threshold specified by the HVAC system;

responsive to a determination that the temperature of the ambient air is less than the temperature threshold specified by the HVAC system, configure the HVAC system to operate in a low-energy cooling mode by opening a first bypass valve, powering off a compressor, powering on a liquid pump, closing a check valve, and opening a second bypass valve.

* * * * *